United States Patent [19]

Strickman et al.

[11] 3,933,161

[45] Jan. 20, 1976

[54] HAIR CURLER AFFIXABLE WITH ONE HAND

[76] Inventors: Donna F. Strickman; Melvyn B. Strickman, both of Academy St., Shiloh, N.J. 08353

[22] Filed: Apr. 28, 1975

[21] Appl. No.: 572,284

[52] U.S. Cl. ..... 132/40
[51] Int. Cl.[2] ..... A45D 2/00
[58] Field of Search ..... 132/40, 42, 9

[56] References Cited

UNITED STATES PATENTS

| | | | |
|---|---|---|---|
| 3,216,427 | 11/1965 | Jefferson | 132/40 |
| 3,812,866 | 5/1974 | Morane | 132/40 |
| 3,862,637 | 1/1975 | Petri | 132/40 |

*Primary Examiner*—G. E. McNeill
*Attorney, Agent, or Firm*—Charles E. Baxley, Esquire

[57] ABSTRACT

This disclosure teaches a hair curler which includes a cylindrical drum and a jaw engageable thereagainst for holding and rolling hair. The jaw is operated from a first end manually by means of a crank. An axial shaft is turnable from a second end to energize a torsion spring which subsequently turns the drum as it deenergizes. A detent and clutch control engaging and releasing of the torsion spring. After the spring is wound, this curler is affixable using one hand.

3 Claims, 12 Drawing Figures

FIG. 1
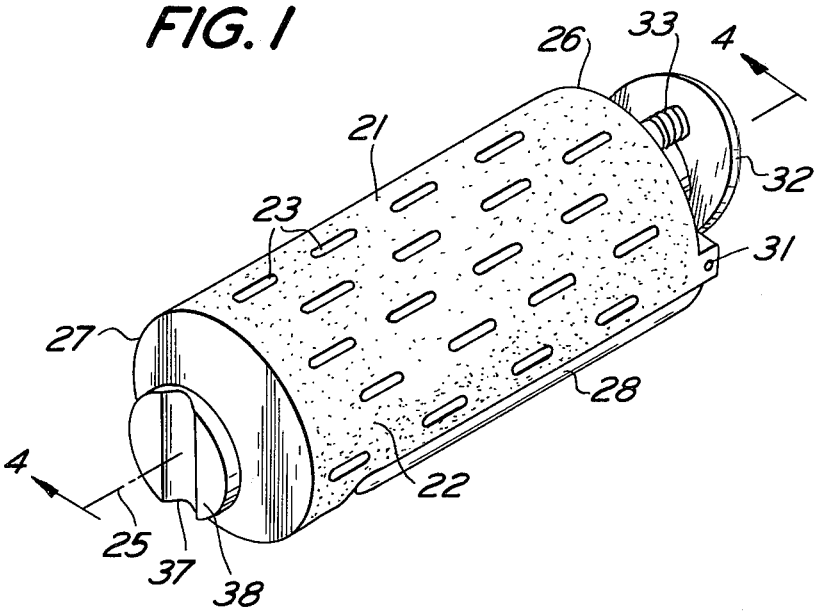
FIG. 2
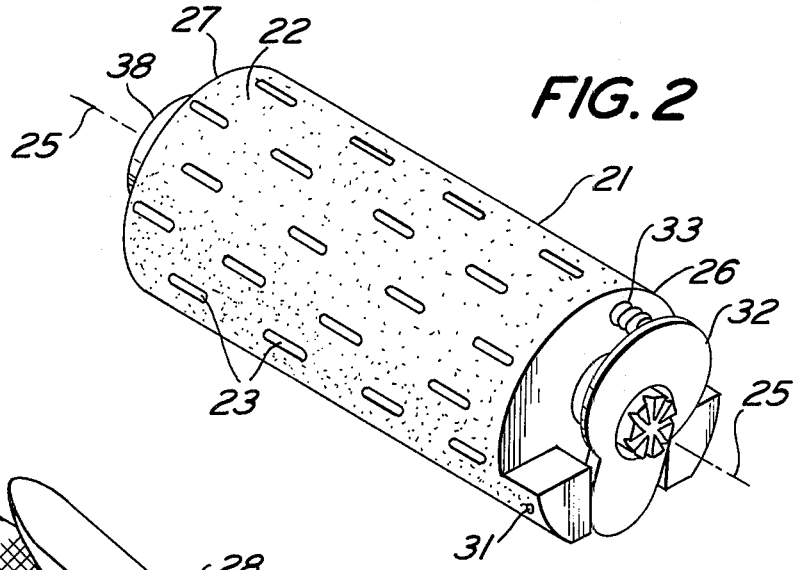
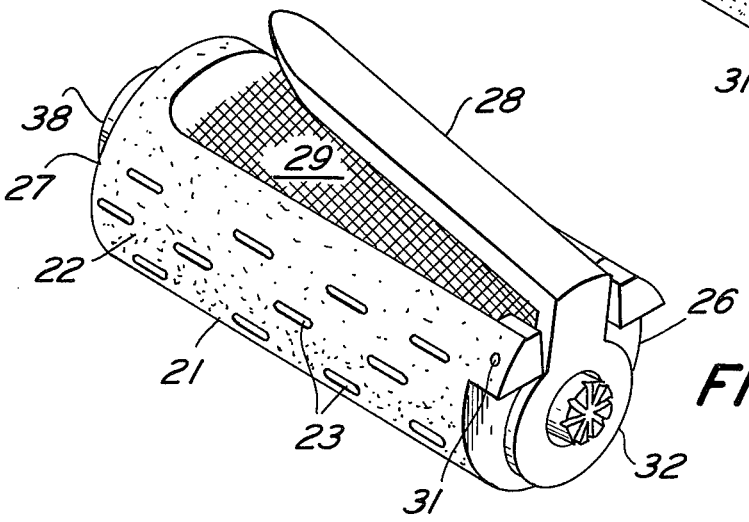
FIG. 3

FIG. 4
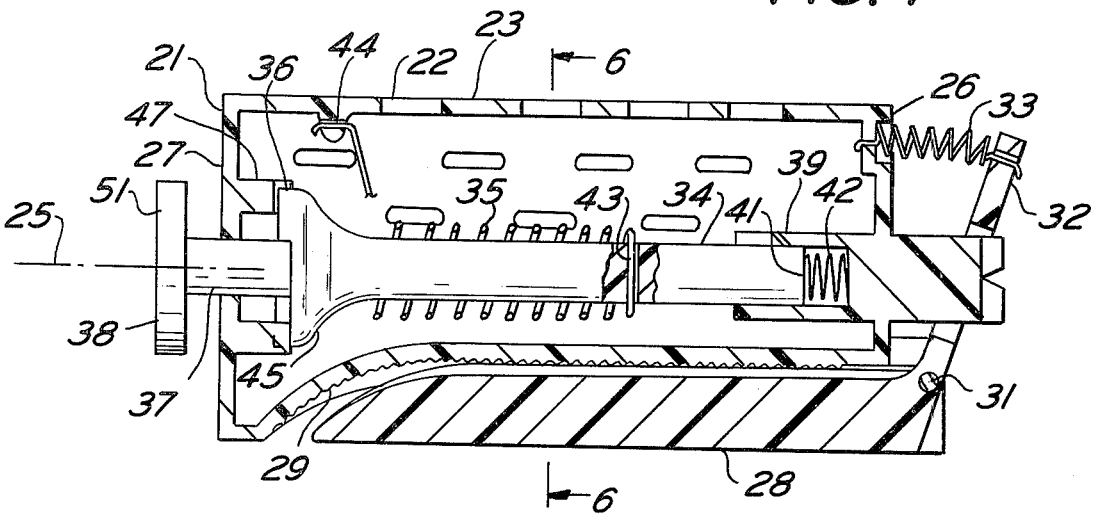
FIG. 5
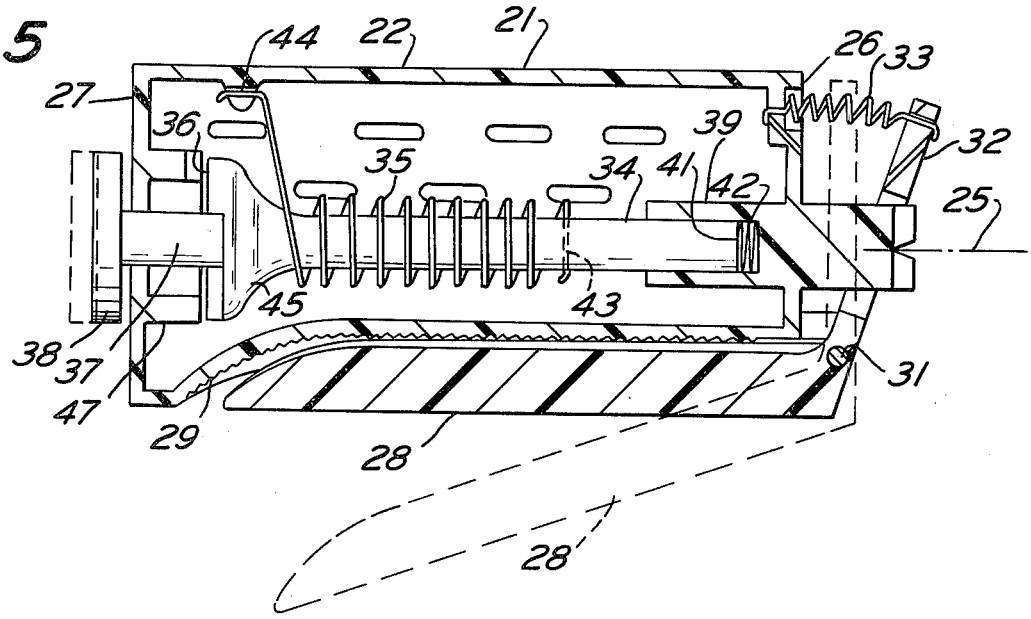
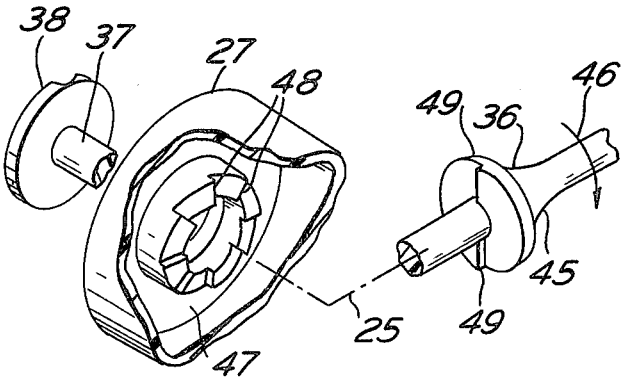
FIG. 7
FIG. 6
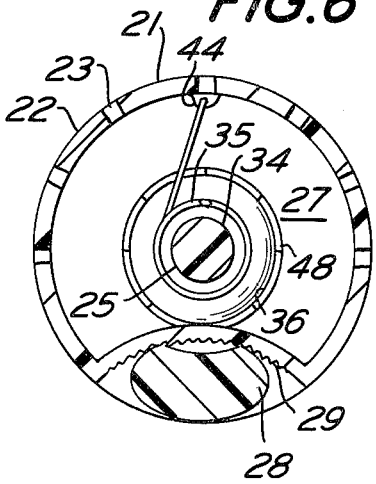

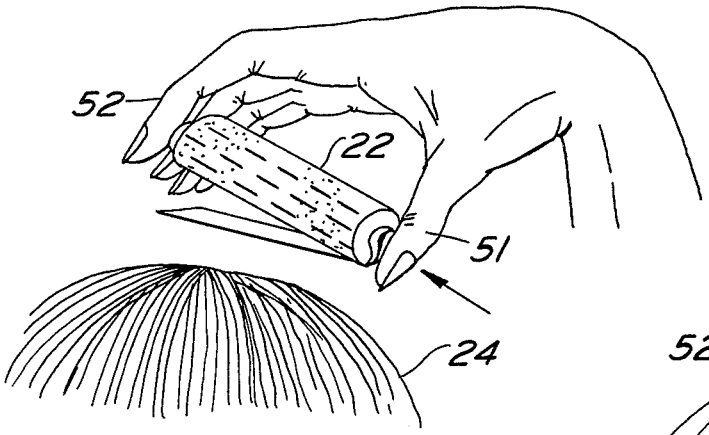
FIG. 8
FIG. 9
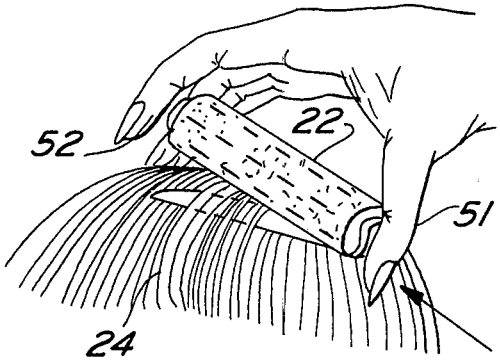
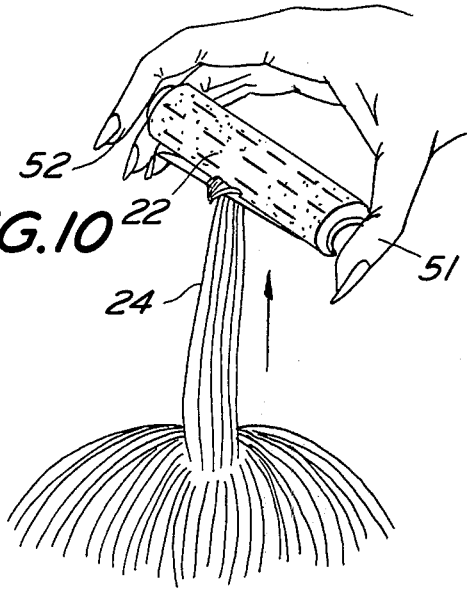
FIG. 10
FIG. 11
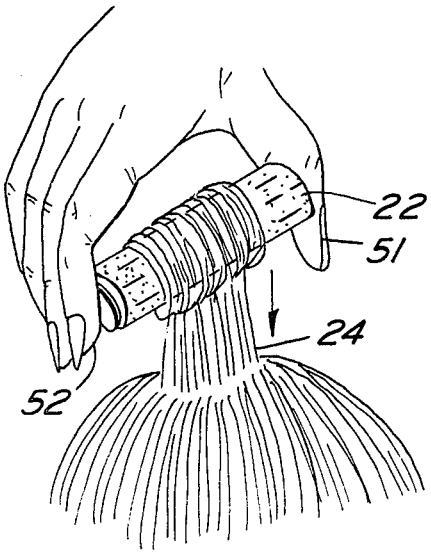
FIG. 12
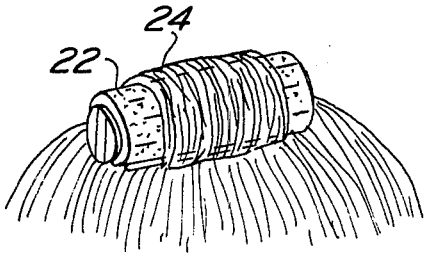

HAIR CURLER AFFIXABLE WITH ONE HAND

BACKGROUND OF INVENTION

This invention relates to hair curlers of the type designed to roll into a user's hair to retain the hair wound thereabout. More particularly this invention relates to hair curlers of the type which have means for retaining the hair in place on the curler as the curler rolls into the hair.

Many hair curlers are known in the prior art comprising a cylindrical drum around which hair is secured and coiled thereto by various means. All of these hair curlers, however, require certain practice by a user as far as curling the hair around the cylindrical drum is concerned. Two hands are necessary to operate these curlers and they do not provide reliable fixing of the hair thereto, particularly when the user rests her head on a pillow as when sleeping.

The present invention overcomes difficulties and shortcomings of the prior art in a particularly useful, novel, unobvious and facile way. A hair curler is provided which includes the traditional cylindrical drum and jaw engageable thereagainst and further this invention embodies automatic means to roll the drum. The jaw is operated manually from a first end by means of a crank as is known in the prior art. An axial shaft is turnable from a second end to energize a torsion spring which subsequently turns the drum as it deenergizes. A detent and clutch control energizing and releasing of the torsion spring. The crank and detent can be operated by a thumb and one other finger of the same hand. Accordingly one object of this invention is to provide a hair curler which, after the torsion spring is wound, can be applied using one hand.

Another object of this invention is to provide a hair curler which is not only easy to use but actually assists the user in winding the hair onto the curler whereby less skill and dexterity are required in its use.

Still another object is to provide a hair curler which aids in drying of the hair so that less time is consumed during drying.

Still another object of this invention is to provide a hair curler which can be manufactured in large scale at low cost so as to have a wide distribution and use.

Still another object of this invention is to provide a hair curler which is suited well otherwise to its intended functions.

DESCRIPTION OF DRAWINGS

The foregoing and other objects, features and advantages will be seen more fully from a detailed description of a preferred embodiment which follows and from claims which also follow all viewed in conjunction with accompanying drawings wherein like numerals refer to like parts throughout and wherein:

FIG. 1 is a side and end perspective view of a hair curler according to this invention.

FIG. 2 is a perspective view showing the other end of the hair curler.

FIG. 3 is another perspective view with the hair curler rotated from the view of FIG. 2.

FIG. 4 is a partly broken sectional view taken along line 4—4 of FIG. 1 of the hair curler with the jaw closed and a clutch engaged.

FIG. 5 is a sectional view of the hair curler similar to FIG. 4 and showing movement of the jaw to its open position in dotted lines as well as the clutch disengaged.

FIG. 6 is a sectional view of the hair curler taken along line 6—6 of FIG. 4.

FIG. 7 is a broken and idealized view depicting the relationship of the shaft, clutch and detent at one end of the hair curler.

FIG. 8 illustrates the hair curler in one hand of a user about to engage hair.

FIG. 9 shows the user picking a section of hair with the jaw of the hair curler.

FIG. 10 shows the user engaging the section of hair between the jaw and the cylindrical drum of the hair curler.

FIG. 11 shows the hair curler winding the section of hair.

FIG. 12 shows the hair curler in place with the section of hair wound thereabout.

DESCRIPTION OF PREFERRED EMBODIMENT

The hair curler according to a preferred embodiment of this invention has a cylindrical drum 21 with an outer surface 22 which may be provided with openings 23 and which may be roughened for improved engagement with a section of hair 24. The drum 21 has an axis 25 as well as a first end 26 spaced longitudinally from a second end 27.

The drum 21 is provided with a jaw 28 arranged longitudinally therealong and receivable into a trough 29. The jaw 28 is connected to the drum 21 by means of a pin 31 about which the jaw 28 rotates between a first closed jaw orientation shown in FIGS. 4 and 5 wherein the jaw 28 is urged to engage into the trough 29 and a second opened jaw orientation shown in dashed lines in FIG. 5 wherein the jaw 28 is spaced from the drum 21. The jaw 28 is operated by a simple crank 32 at the first end 26 of the drum 21 and connected rigidly to the jaw 28 for rotating the jaw 28 about the pin 31. A crank spring 33 is connected between the drum 21 and the crank 32 to urge the jaw 28 normally into its first closed jaw orientation as seen in FIG. 4. In operation a user presses the crank 32 toward the drum 21 to open the jaw 28 whereby it can receive the hair section 24 therein. On releasing the crank 32 the crank spring 33 closes the jaw 28 thus engaging the hair section 24.

The crux of the present invention is provision of automatic winding of the hair section 24 on the drum 21. Toward this objective an axial shaft 34 coacts with a torsion spring 35, a clutch 36, a detent 37 and a knob 38. The first end 26 of the drum 21 is provided with a bearing 39 organized along the axis 25 and adapted to receive a first end 41 of the shaft 34 journaled axially therein. A shaft biasing spring 42 is provided between the bearing 39 and the first end 41 of the shaft 34 normally to urge the shaft 34 toward the second end 27 of the drum 21. The torsion spring 35 is connected to the shaft at 43 and it wraps about the shaft for several turns and is anchored to the drum at 44. The torsion spring 35 is capable of storing elastic energy therein by winding of the shaft 34. The torsion spring 35 thereafter gives up that stored elastic energy to turn the drum 21 about the axis 25 for rolling the hair section 24 onto the outer surface 22.

A second end 45 of the shaft 34 at the second end 27 of the drum 21 is provided with the clutch 36 which when engaged is rotatable about the axis 25 only in a positive sense 46 of rotation as shown in FIG. 7 and is not rotatable in a negative sense of rotation opposite thereto. The second end 27 of the drum 21 is provided with a clutch seat 47 having teeth 48 and projecting into the drum 21 for engagement with teeth 49 of the clutch 36. The detent 37 penetrates the drum 21 via the second ends 27 thereof along the axis 25. The detent 37 is connected to the clutch 36 and is moveable manually opposite the detent biasing spring 42 to a first detent position shown in FIG. 5 so as to disengage the clutch 36 from the clutch seat 47. The detent 37 has the knob 38 on its outward end which is used for turning the shaft 34 manually, thereby winding the torsion spring 35.

Accordingly for full operation of this hair curler a user turns the knob 38 clockwise relative the second end 27 of the drum 21. The teeth 48 of the clutch seat 47 coact with the teeth 49 of the clutch 36 to facilitate winding of the torsion spring 35 in the correct positive sense 46 of rotation about the axis as shown in FIG. 7. The hair curler is then holdable between a thumb 51 and an index finger 52 of the same hand, with one on the detent 37 and the other on the crank 32. The crank 32 is held to the first ends 26 of the drum 21 as shown in dashed lines on FIG. 5 and in FIG. 8 until the hair section 24 is selected as shown in FIG. 9. The crank is released and, after the curler has been pulled to the end of the hair section 24 as shown in FIG. 10 then the detent 37 is pushed to its first detent position shown in FIG. 5 whereby the clutch 36 is disengaged. The shaft 34 is supported by the user's thumb 51 and index finger 52 so released elastic energy from the wound torsion spring 35 turns the drum 21 about the shaft 34 and the axis 25, thereby winding the hair section 24 onto the outer surface 22 of the drum 21.

It will be apparent to those skilled in manufacture and use of hair curlers that wide deviations may be made from the preferred embodiment shown and described herein without departing from a main theme of invention set forth in claims which follow.

We claim:

1. A hair curler comprising in combination:

a cylindrical drum having a circumferential outer surface, the drum having an axis and a first end spaced longitudinally from a second end, the drum provided with a jaw arranged longitudinally therealong and moveable between a first jaw orientation wherein it is urged to engage the outer surface of the drum and a second jaw orientation wherein it is spaced from the drum, a crank connected fixedly to the jaw and connected hingedly to the drum at said first end, a crank spring connected between the drum and the crank to urge the jaw normally into said first jaw orientation, the crank moveable manually from said first jaw orientation to said second jaw orientation overcoming the crank spring, the first end of the drum provided with a bearing organized along the axis and adapted to receive a shaft journaled axially therein, a shaft biasing spring connected between the bearing and the shaft normally to urge the shaft toward the second end of the drum, the shaft provided at the second end of the drum with a clutch which is rotatable only in a positive sense of rotation about said axis and not rotatable in a negative sense of rotation thereabout, the second end of the drum provided with a clutch seat projecting into the drum to engage the clutch, a detent penetrating the drum via the second end thereof and along the axis, the detent connected to the clutch, the detent moveable manually to a first detent position overcoming the detent biasing spring to disengage the clutch, the detent having a knob connected thereto and outward of the second end, the knob turnable to rotate the shaft in said positive sense, a torsion spring connected between the drum and the shaft to store energy on said rotating of the shaft in said positive sense and for giving up said energy to turn the drum on unwinding in said negative sense whereby a hair section engaged between the jaw and the outer surface of the drum is rolled onto the drum.

2. The curler of claim 1 sized so that, after the torsion spring has the energy stored therein, a thumb and another finger on a single hand of the user can operate both the crank and the detent.

3. The hair curler of Claim 2 with the outer surface of the drum having a trough into which the jaw is receivable.

* * * * *